US009242490B1

(12) United States Patent
Nozaki

(10) Patent No.: US 9,242,490 B1
(45) Date of Patent: Jan. 26, 2016

(54) BANKBOOK PRINTING APPARATUS AND BANKBOOK PRINTING METHOD

(71) Applicant: TOSHIBA TEC KABUSHIKI KAISHA, Shinagawa-ku, Tokyo (JP)

(72) Inventor: Mitsuhiro Nozaki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/522,674

(22) Filed: Oct. 24, 2014

(51) Int. Cl.

| | |
|---|---|
| ***B41J 2/165*** | (2006.01) |
| ***B41J 13/10*** | (2006.01) |
| ***B41J 2/32*** | (2006.01) |
| ***B41J 13/02*** | (2006.01) |

(52) U.S. Cl.
CPC *B41J 13/106* (2013.01); *B41J 2/32* (2013.01); *B41J 13/02* (2013.01)

(58) Field of Classification Search
None
See application file for complete search history.

(56) References Cited

U.S. PATENT DOCUMENTS

| | | | | |
|---|---|---|---|---|
| 4,280,036 | A * | 7/1981 | Fukatsu | 235/379 |
| 4,600,828 | A * | 7/1986 | Nogami et al. | 235/379 |
| 5,017,026 | A * | 5/1991 | Takesako et al. | 400/24 |

FOREIGN PATENT DOCUMENTS

| | | |
|---|---|---|
| JP | 2010-214617 | 9/2010 |

* cited by examiner

*Primary Examiner* — Alejandro Valencia
(74) *Attorney, Agent, or Firm* — Amin, Turocy & Watson, LLP

(57) ABSTRACT

A bankbook printing apparatus 100 comprises a bankbook printing section 130 configured to print on a bankbook conveyed from an insertion opening 111 in an opened state; a closing mechanism 150 configured to close the bankbook printed by the printing section 130; and a conveyance mechanism 110 configured to convey the bankbook inserted into the insertion opening 111 in an opened state towards a downstream and to convey the bankbook closed by the closing mechanism 150 towards an upstream where the insertion opening 111 is arranged and discharge the closed bankbook from the insertion opening 111.

9 Claims, 11 Drawing Sheets

BANKBOOK PRINTING APPARATUS AND BANKBOOK PRINTING METHOD

FIELD

Embodiments described herein relate to a bankbook printing apparatus and a bankbook printing method.

BACKGROUND

A bankbook printing apparatus for printing on a bankbook is known from the insertion opening of which a bankbook is inserted into and discharged from the bankbook printing apparatus generally in an opened state.

DETAILED DESCRIPTION

In accordance with an embodiment, a bankbook printing apparatus comprises a bankbook printing section configured to print on a bankbook conveyed from an insertion opening in an opened state; a closing mechanism configured to close the bankbook printed by the bankbook printing section; and a conveyance mechanism configured to convey the bankbook inserted into the insertion opening in an opened state towards a downstream and to convey the bankbook closed by the closing mechanism towards an upstream where the insertion opening is arranged and discharge the closed bankbook from the insertion opening.

Embodiments of the present invention are described below with reference to the accompanying drawings, in which the identical or equivalent elements are denoted with the identical reference symbols.

In accordance with the present embodiment, a bankbook printing apparatus 100 is an apparatus for printing information such as transaction content on a bankbook. The bankbook printing apparatus 100 may be arranged in, for example, an ATM (Automated Teller Machine). With the bankbook printing apparatus 100, a sheet called statement is discharged, together with the bankbook. Here, the 'statement' refers to a sheet on which the details of a transaction and the like are recorded.

Figure 1:
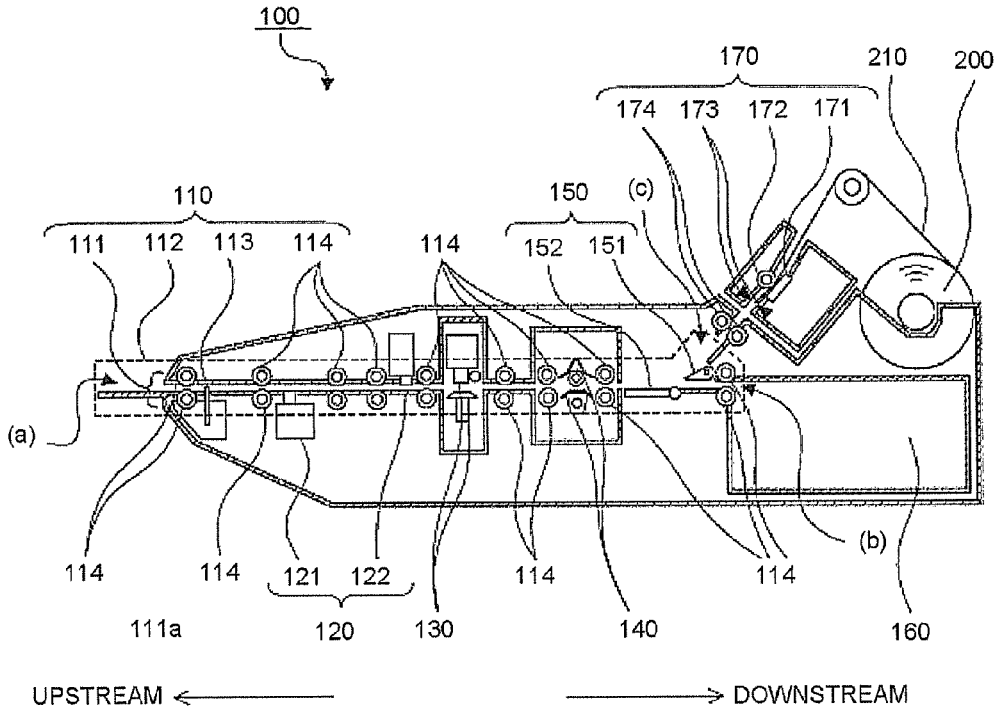
FIG. 1 is a diagram illustrating the internal configuration of a printing apparatus according to an embodiment.
Figure 2:
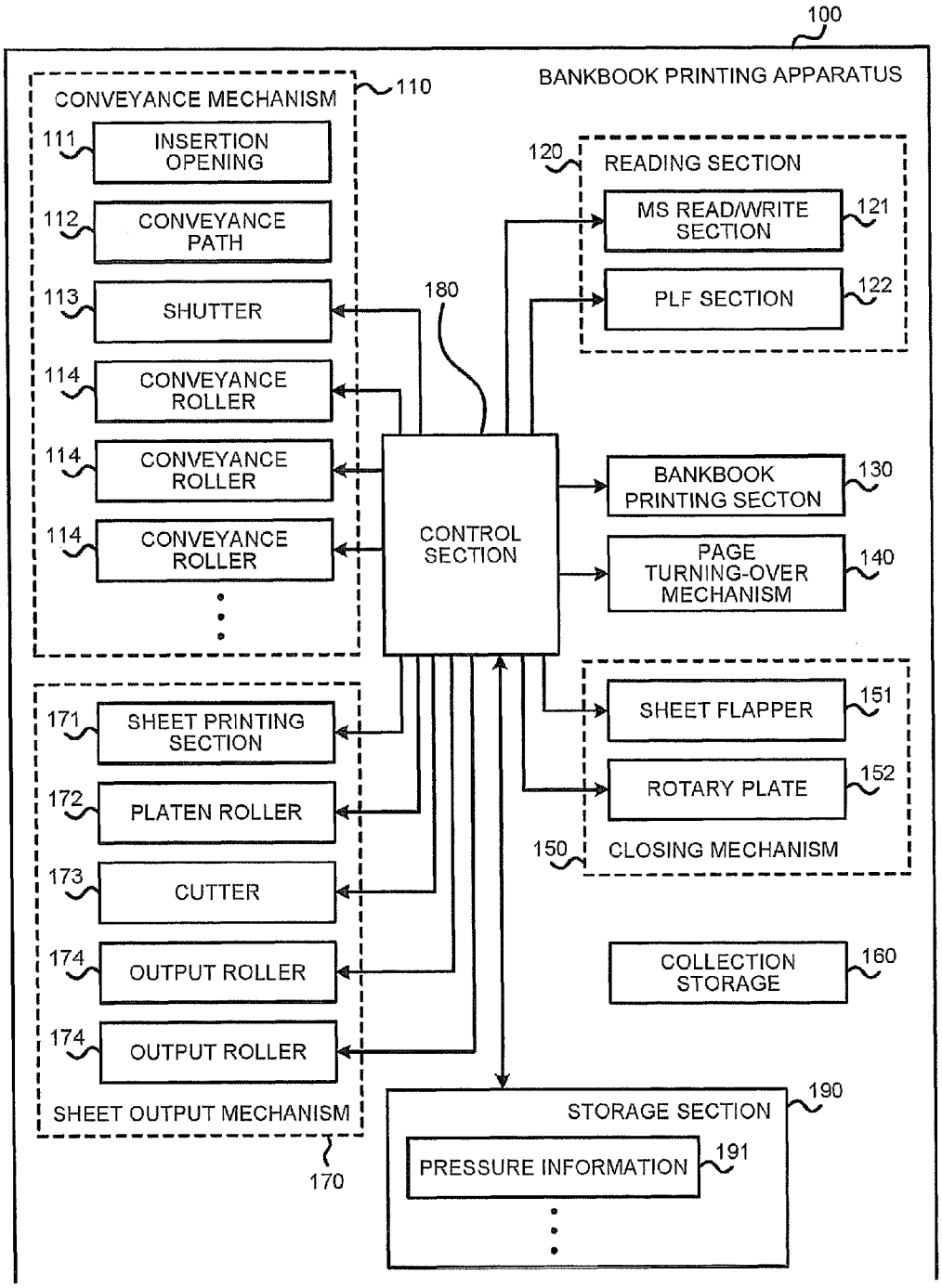
FIG. 2 is a block diagram illustrating a printing apparatus according to an embodiment.

As shown in FIG. 1, the bankbook printing apparatus 100 comprises a conveyance mechanism 110, a reading section 120, a bankbook printing section 130, a page turning-over mechanism 140, a closing mechanism 150, a collection storage 160 and a sheet output mechanism 170. Further, as shown in FIG. 2, a control section 180 and a storage section 190 are arranged inside the bankbook printing apparatus 100.

The conveyance mechanism 110 is a mechanism for conveying a bankbook to each section inside the apparatus. As shown in FIG. 1, the conveyance mechanism 110 consists of an insertion opening 111, a conveyance path 112, a shutter 113 and conveyance rollers 114.

Figure 3:
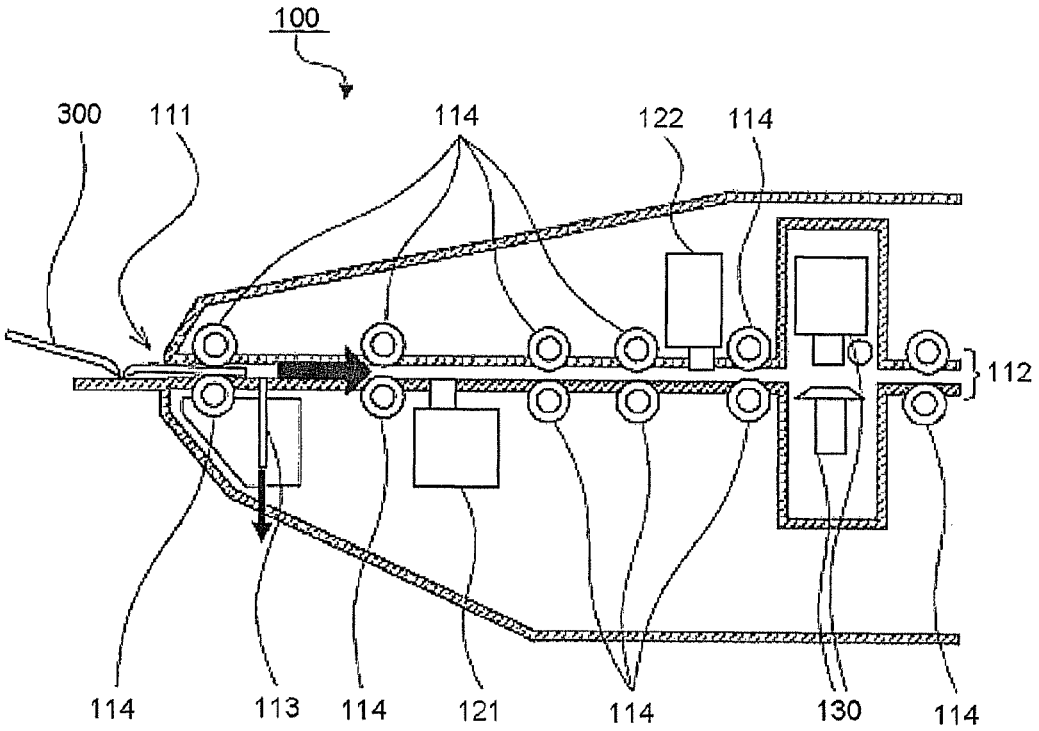
FIG. 3 is a diagram illustrating a state in which a bankbook is inserted into an insertion opening.
Figure 4:
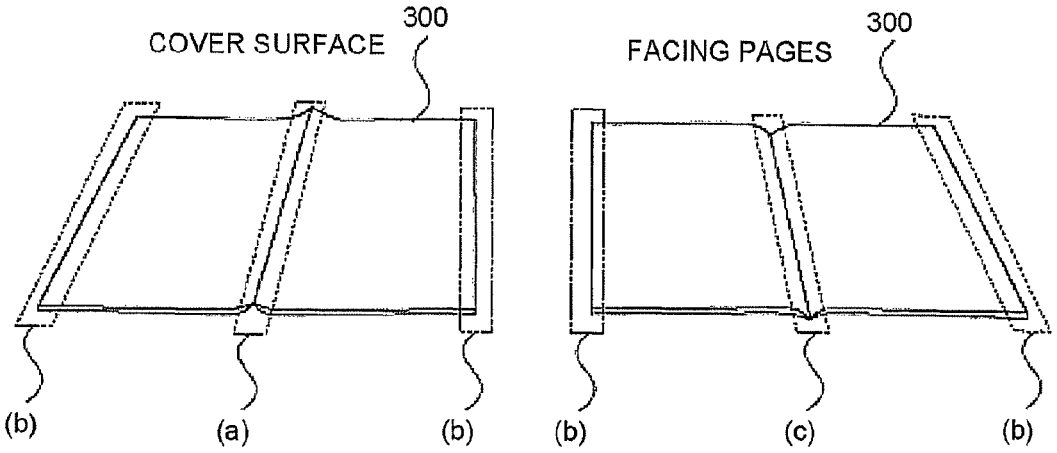
FIG. 4 is a diagram illustrating an opened bankbook.

The insertion opening 111 is an opening for the user to insert a bankbook 300 into the bankbook printing apparatus 100. For example, as shown in FIG. 3, the bankbook 300 is inserted into the apparatus from the insertion opening 100 with facing pages thereof facing up. Further, to facilitate the understanding of the present invention, the side of the two-page spread pages of the opened bankbook 300 is hereinafter referred to as 'facing pages' and the opposite side is hereinafter referred to as 'cover surface'. Further, the back part (the part (a) shown in FIG. 4) of the bankbook 300 is called 'back', and the part (the part (b) shown in FIG. 4) opposite to the back of the bankbook 300 when the bankbook 300 is closed is called 'front fore edge'. Further, the part (the part (c) shown in FIG. 4) connected with the back of the facing pages is called 'binding edge'.

Figure 5:
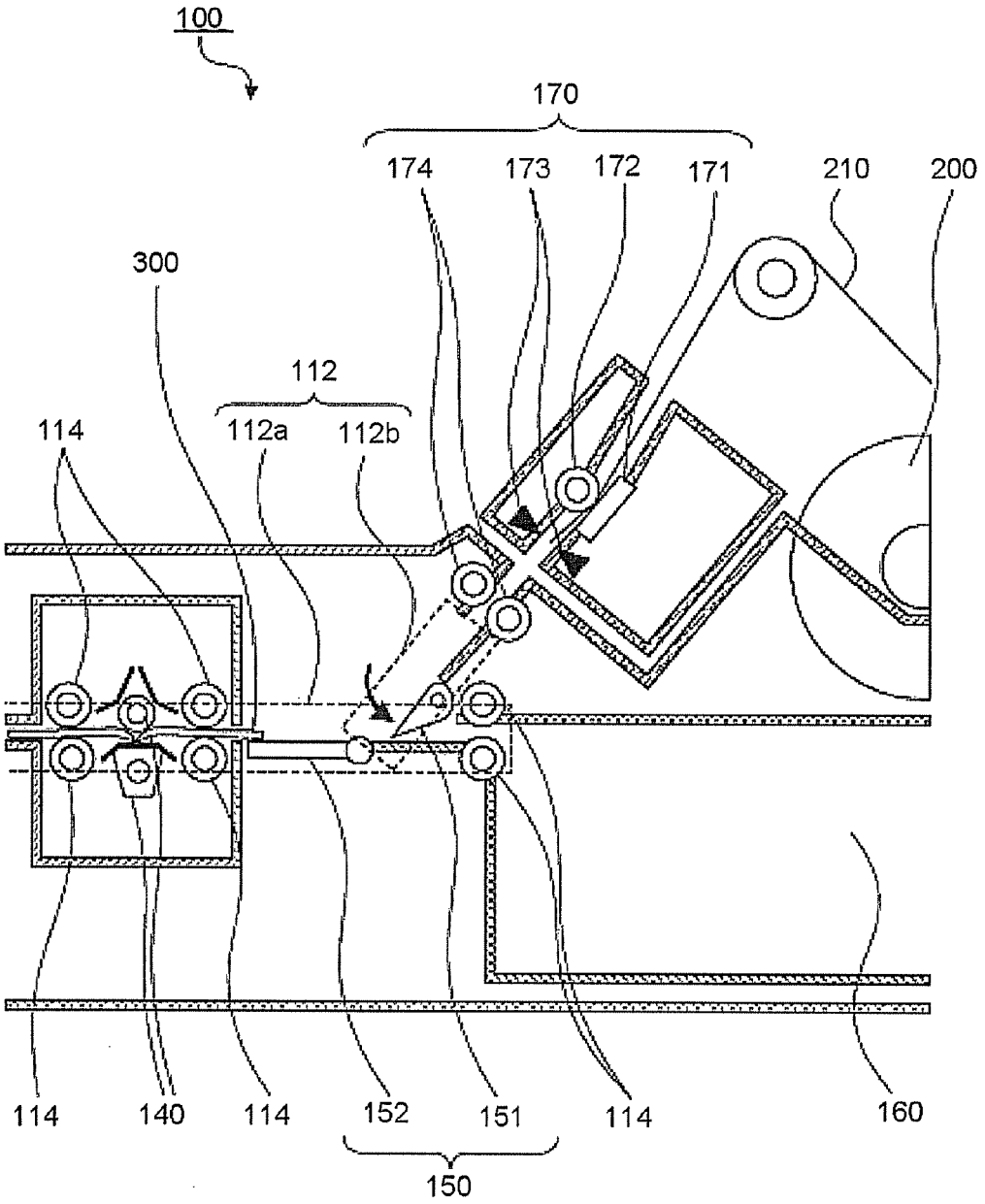
FIG. 5 is an enlarged view of the merging part of a first and a second conveyance path.

The conveyance path 112 is a part serving as a path of the bankbook 300 when the bankbook 300 is conveyed. As shown in FIG. 1, the conveyance path 112 is formed in a substantially linear shape from the insertion opening 111 to the inside of the apparatus. As shown in FIG. 5, the conveyance path 112 is branched into two paths at the downstream rear end thereof. Specifically, the conveyance path 112 is branched into a path linearly leading to the collection storage 160 and a path leading to the sheet output mechanism 170 from the linear path. Further, to facilitate the understanding of the preset invention, the path from the insertion opening 111 to the collection storage 160 is hereinafter referred to as a first conveyance path 112*a* and the path branched from the first conveyance path 112*a* and leading to the sheet output mechanism 170 as a second conveyance path 112*b*. Further, the side (the side (a) shown in FIG. 1) of the insertion opening 111 on the conveyance path 112 is referred to as 'upstream side' and the opposite sides (e.g. the sides (b) and (c) shown in FIG. 1) as 'downstream side'.

The shutter 113 is a gate for opening or closing the insertion opening 111. The shutter 113 consisting of a hard, such as a metal or a solid resin, plate-like body is substantially arranged at the downstream side of the insertion opening 111. The shutter 113 moves up and down under the control of the control section 180 to open or close the insertion opening 111. The control section 180 closes the shutter 113 immediately the bankbook 300 enters the conveyance path 112, thereby preventing the insertion of a new bankbook 300 into the bankbook printing apparatus 100.

The conveyance rollers 114 are rollers for conveying the bankbook 300. The conveyance roller 114 consists of, for example, a cylinder the external periphery of which is covered by an elastic element such as rubber and the like. The conveyance rollers 114 are pairs of upper and lower rollers.

Figure 6:
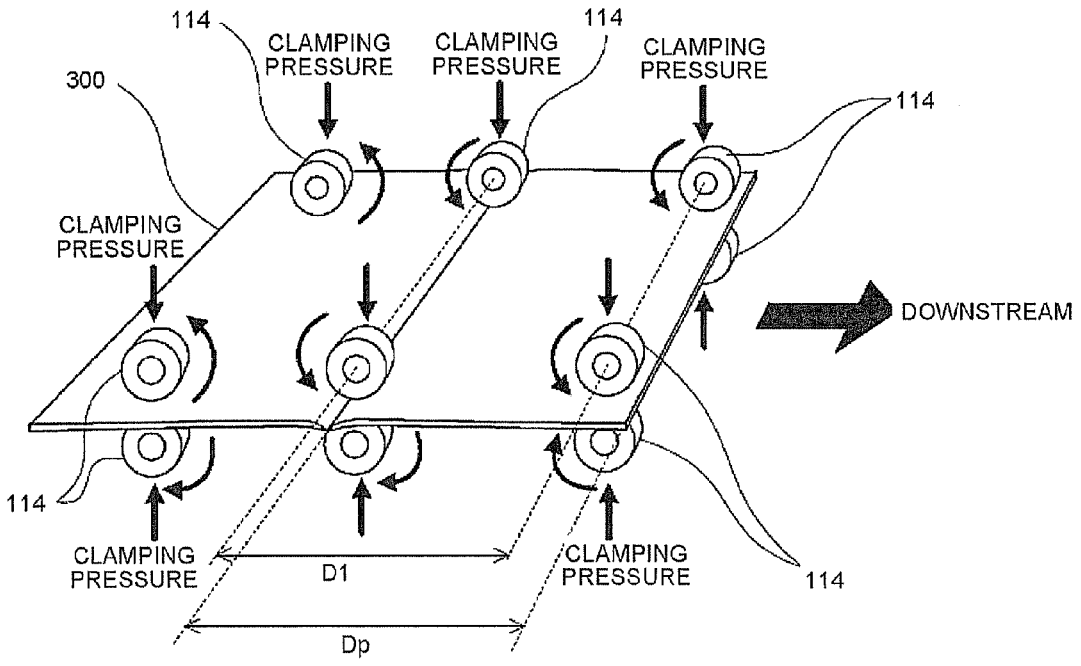
FIG. 6 is a diagram illustrating a state in which an opened bankbook is conveyed to downstream.

For example, as shown in FIG. 6, each pair of upper and lower conveyance rollers 114 conveys the bankbook 300 towards the upstream or downstream side while applying a clamping pressure to the bankbook 300. The conveyance roller 114 can be changed in rotation direction, rotation speed and rotation quantity and can change the clamping pressure applied to the bankbook 300. Under the control of the control section 180, the rotation direction, the rotation speed and the rotation quantity of the conveyance roller 114 and the clamping pressure applied by the conveyance roller 114 can be changed at any time. A plurality of conveyance rollers 114 are arranged at intervals in the conveyance path 112. The interval D1 at which the conveyance rollers 114 are arranged in the advancement direction of the bankbook is smaller than the width DP of each page of the bankbook 300. Thus, the conveyance roller 114 can convey the bankbook 300, even if the bankbook 300 is closed, to the upstream or the downstream. Further, a pressure sensor (not shown) is arranged on the furthest upstream conveyance roller 114 on the conveyance path 112 to capture the change in the clamping pressure. The control section 180 detects whether or not the bankbook 300 is inserted into the insertion opening 111 according to the value of the pressure sensor.

Return to FIG. 1, the reading section 120 is a reading device for reading various kinds of information recorded in the bankbook 300. The reading section 120 consists of an MS (Magnetic Stripe) read/write section 121 and a PLF (Page Line Finder) section 122.

The MS read/write section 121 is a magnetic data reader/writer for reading/writing data from/into the magnetic stripe of the bankbook 300. Further, the magnetic stripe refers to a strip-shaped magnetic part stuck on the bankbook 300. The MS read/write section 121 operates under the control of the control section 180 to read/write data from/into the magnetic stripe. Further, the information recorded in the magnetic stripe is hereinafter referred to as 'magnetic data'. The magnetic data is, for example, the information such as an account number and the like.

The PLF section 122 is a device for detecting the currently opened page of the bankbook 300 or the last write line of the currently opened page. The PLF section 122 consists of, for example, an optical device for reading the page information (e.g. page number) printed on each page of the bankbook 300 or the characters printed on a line. The PLF section 122 sends the read page information or information of the last write line from the bankbook 300 to the control section 180.

The bankbook printing section 130 is a printer for printing various kinds of information such as transaction information and the like on the bankbook 300. The bankbook printing section 130 consisting of, for example, a dot printer activates a print head such as a dot head and the like under the control of the control section 180 to print various kinds of information on the bankbook 300.

The page turning-over mechanism 140 is a mechanism for turning over pages of the bankbook 300. The page turning-over mechanism 140 turns over, under the control of the control section 180, the pages in a forward direction or in a reverse direction. The page turning-over mechanism 140 turns over the pages in various known ways but not in a given way. Further, 'turns over pages in a forward direction' means turning over pages towards the last page of the bankbook 300, and 'turn over pages in a reverse direction' means turning over pages towards the leading page of the bankbook 300.

The closing mechanism 150 which is a mechanism for closing the bankbook 300 printed by the bankbook printing section 130 consists of a sheet flapper 151 and a rotary plate 152.

The sheet flapper 151 is a switching device for switching the movement directions of the bankbook 300. As shown in FIG. 5, the sheet flapper 151 is arranged at the merging part of the first conveyance path 112*a* and the second conveyance path 112*b*. A rotation shaft fixed on the bankbook printing apparatus 100 is arranged on the sheet flapper 151. The sheet flapper 151 rotates around the rotation shaft to switch the movement direction of the bankbook 300.

The rotary plate 152 which is a plate-like body for closing the bankbook 300 is arranged nearby the merging part of the first conveyance path 112*a* and the second conveyance path 112*b*. The rotation shaft of the rotary plate 152 is arranged on the end part of the rotary plate at the downstream side. The rotary plate 152 rotates around the rotation shaft which is substantially located at the upstream side of the sheet flapper 151 to close the bankbook 300. Further, the operations of the closing mechanism 150 are described in detail with reference to the under-mentioned 'bankbook printing processing'.

The collection storage 160 is a storage for storing the bankbook 300 which is returned from the insertion opening 111 after being forgotten to be taken away by the user.

The sheet output mechanism 170 is a mechanism for outputting a sheet 210 towards the bankbook 300. The sheet 210 is fed from a roll 200 which is a roll of sheet 210 detachably arranged on the bankbook printing apparatus 100. In addition to the function of outputting the sheet 210, the sheet output mechanism 170 further has a function of printing on the sheet 210. Thus, the sheet output mechanism 170 functions as a sheet printing section. The sheet output mechanism 170 consists of a print head 171, a platen roller 172, a cutter 173 and an output roller 174.

The print head 171 is a thermal head on which a plurality of heating elements is arranged in a row. The print head 171 selectively heats the heating elements under the control of the control section 180 to thermally transfer ink (not shown) onto the sheet 210. The print head 171 is arranged below the platen roller 172 to print information merely on the lower side of the sheet 210. Further, the side of the sheet 210 printed by the print head 172 is hereinafter referred to as a 'printing surface', and the opposite side is hereinafter referred to as a 'non-printing surface'. Further, the non-printing surface is not definitely blank paper. The sheet may be partially printed in advance before being printed by the print head 171. The part printed in advance is, however, deemed as the non-printing surface.

The platen roller 172 is a roller for propping the sheet 210 against the print head 171. The platen roller 172 consists of, for example, a cylinder the external peripheral surface of which is covered by an elastic element. The platen roller 172 conveys the sheet 210 contacted with the outer peripheral surface thereof to the downstream under the control of the control section 180.

The cutter 173 is a cutting component for cutting the sheet 210. The cutter 173 is arranged at the upstream side of the print head 171 to cut and separate the sheet 210 the printed part of which is printed by the print head 171 from the other left part of the sheet 210.

The output roller 174 is a roller for outputting the sheet 210 cut and separated by the cutter 173 to the upstream. The output roller 174 consists of, for example, a cylinder the external peripheral surface of which is covered by an elastic element. Like the conveyance rollers 114, the output roller 174 is a pair of upper and lower rollers. The pair of upper and lower output rollers 174 conveys the sheet 210 towards the upstream while applying a clamping pressure to the sheet 210. Like the conveyance roller 114, the output roller 174 can be changed in rotation direction, rotation speed and rotation quantity and can change the clamping pressure applied to the sheet 210. Under the control of the control section 180, the rotation direction, the rotation speed and the rotation quantity of the output roller 174 and the clamping pressure applied by the output roller 174 can be changed.

Return to FIG. 2, the control section 180 consists of a processing device such as a processor. The control section 180 operates according to a program stored in an ROM (Read Only Storage) (not shown) or RAM (Random Access Storage) (not shown) to realize various operations including the under-mentioned 'bankbook printing processing'. The control section 180 consists of one or more processors. In the case where the control section 180 consists of a plurality of processors, the control section 180 may realize a bankbook printing processing through the cooperation of the plurality of processors.

The storage section 190 consists of a storage device such as a DRAM (Dynamic Random Access Storage), an SRAM (Static Random Access Storage), a semiconductor memory, a hard disk and the like which is capable of reading or writing data. Various kinds of information, including pressure information 191, are stored in the storage section 190.

The pressure information 191 is information of the clamping pressure applied by the conveyance roller 114 to the bankbook 300. The pressure information 191 contains information of the magnitude of the clamping pressure applied by the conveyance roller 114 to the bankbook 300 when the bankbook 300 is conveyed in an opened state and information of the magnitude of the clamping pressure applied by the conveyance roller 114 to the bankbook 300 when the bankbook 300 is conveyed in a closed state. Further, the clamping pressure applied to the closed bankbook 300 is smaller than that applied to the opened bankbook 300.

Next, the operations of the bankbook printing apparatus 100 with the structure above are described below.

When detecting the insertion of the bankbook 300 into the insertion opening 111, the control section 180 of the bankbook printing apparatus 100 starts a bankbook printing processing. As stated above, the bankbook 300 is inserted into the insertion opening with facing pages facing up. The bankbook printing processing is described below with reference to FIG. 7.

The control section 180 conveys the opened bankbook 300 inserted into the insertion opening 111 towards the downstream (ACT S101). At this time, the control section 180 properly changes the pressure applied to the bankbook 300 according to the pressure information 191 stored in the storage section 190.

Next, the control section 180 activates the reading section 120 to acquire information from the bankbook 300 during the conveyance of the bankbook 300 towards the downstream. Specifically, the control section 180 activates the MS read/write section 121 to acquire magnetic data from the bankbook 300. Besides, the control section 180 activates the PLF section 122 to acquire the page information of the currently opened page of the bankbook 300 and the information of the last write line of the page (ACT S102). The acquired information is temporarily stored in an RAM (not shown).

If the bankbook 300 reaches the page turning-over mechanism 140, the control section 180 stops the conveyance of the bankbook 300 on one end. Moreover, the control section 180 activates the page turning-over mechanism 140 to turn over the bankbook 300 until the page to be printed appears (ACT S103). The number of the turned-over pages is determined according to the page information stored in the RAM (not shown). Further, if the page to be printed is the currently opened page, the control section 180 conveys the bankbook 300 to the bankbook printing section 130 without changing the state of the bankbook 300, but not stops the conveyance of the bankbook 300.

The control section 180 stops conveying the bankbook 300 after the bankbook 300 is conveyed to the bankbook printing section 130. Moreover, the control section 180 carries out printing on the currently opened page of the bankbook 300 (ACT S104). If non-printed lines are used up during the printing process, the control section 180 returns the bankbook 300 to the page turning-over mechanism 140 to turn over one page of the bankbook 300 in the forward direction, and then the control section 180 continues to print on the new page.

Figure 8:
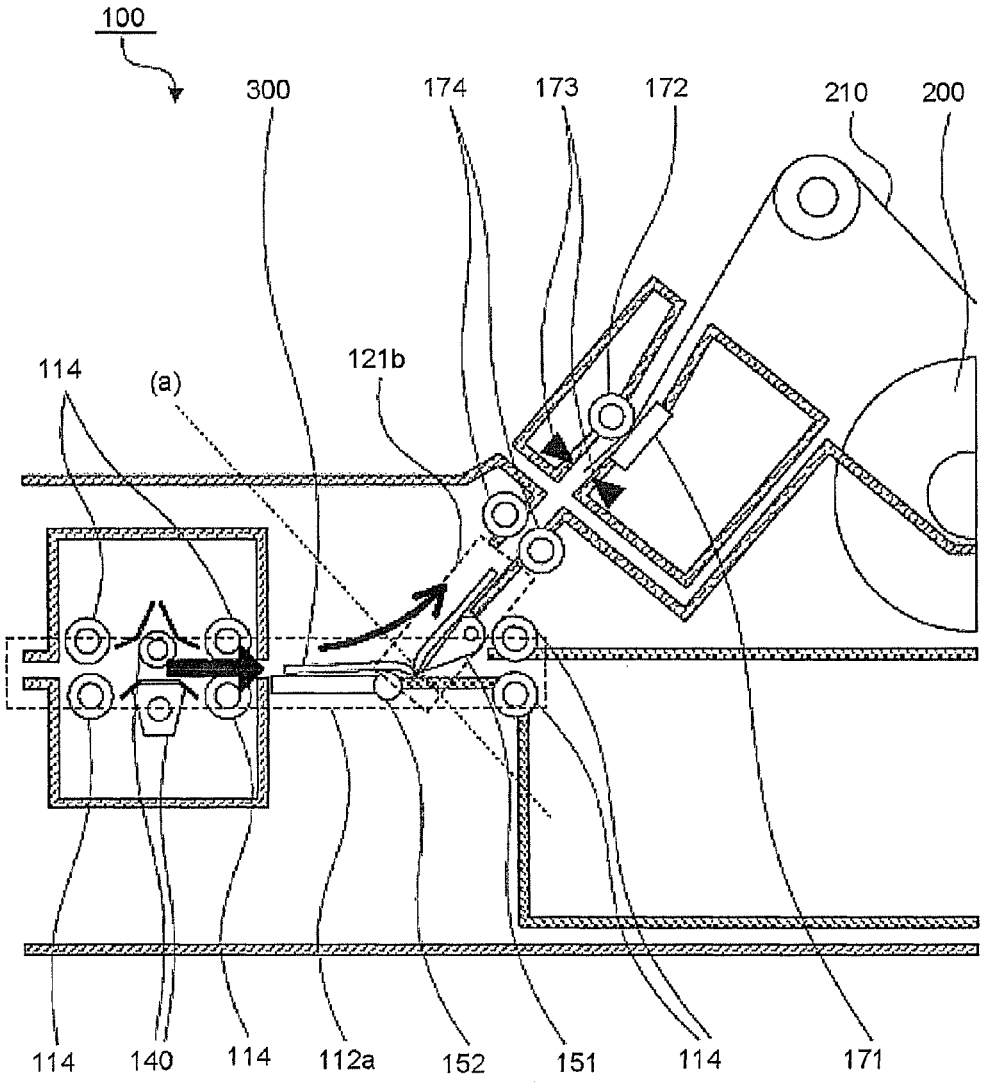
FIG. 8 is a diagram illustrating a state in which half of a bankbook at the downstream side is ridden on the second conveyance path.

After completing the printing, the control section 180, as shown in FIG. 5, enables the sheet flapper 151 to rotate anticlockwise to form a second conveyance path 112*b* on the conveyance path 112. Moreover, for example, as shown in FIG. 8, the control section 180 conveys the bankbook 300 towards the downstream until the half of the bankbook 300 at the downstream side is ridden on the second conveyance path 112*b*, that is, until the back of the bankbook 300 reaches the merging part (the position (a) shown in FIG. 8, which is hereinafter referred to as 'merging position' for short) of the first conveyance path 112*a* and the second conveyance path 112*b* (ACT S105).

Figure 7:
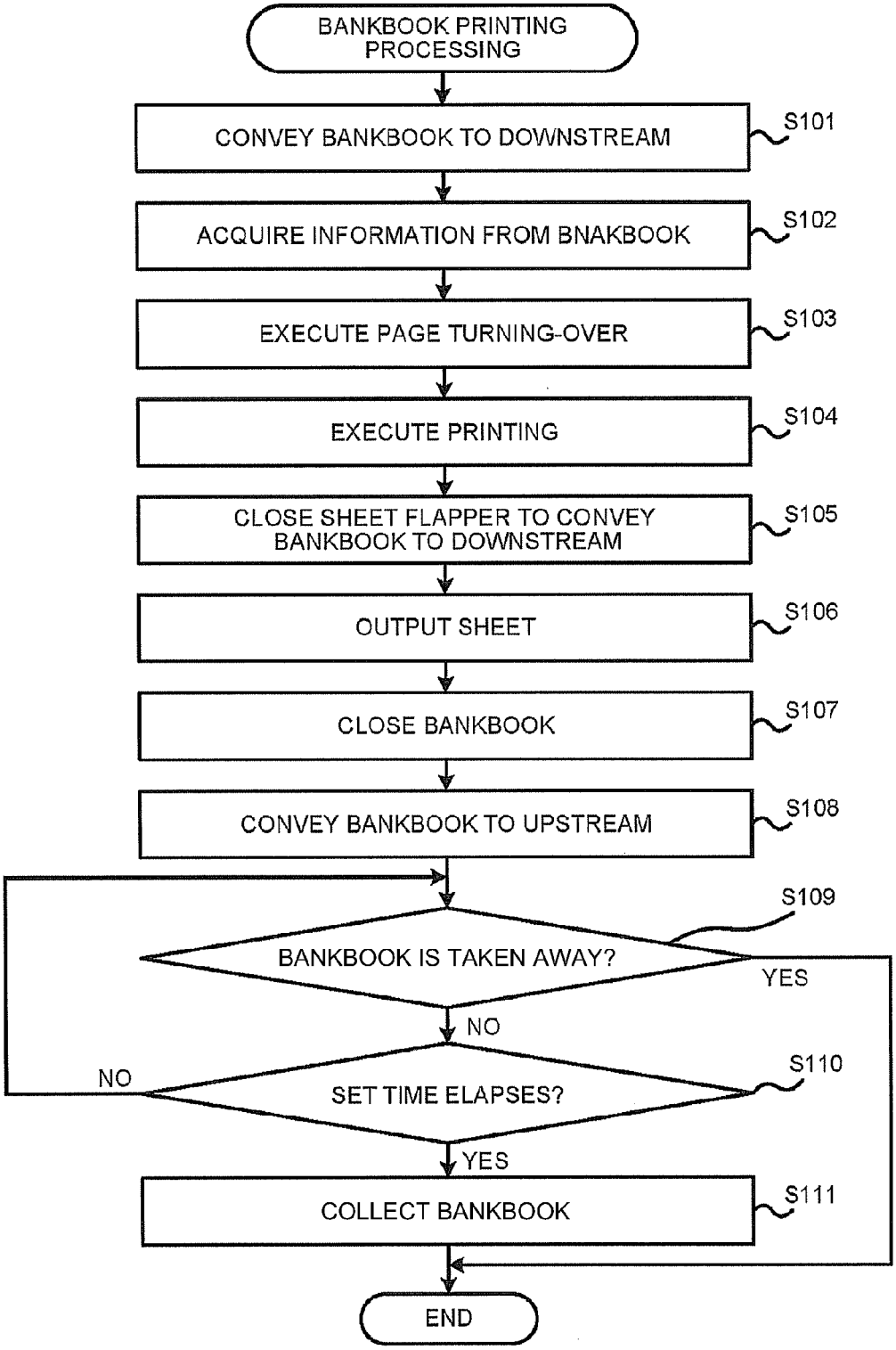
FIG. 7 is a flowchart illustrating a bankbook printing processing according to an embodiment.
Figure 9:
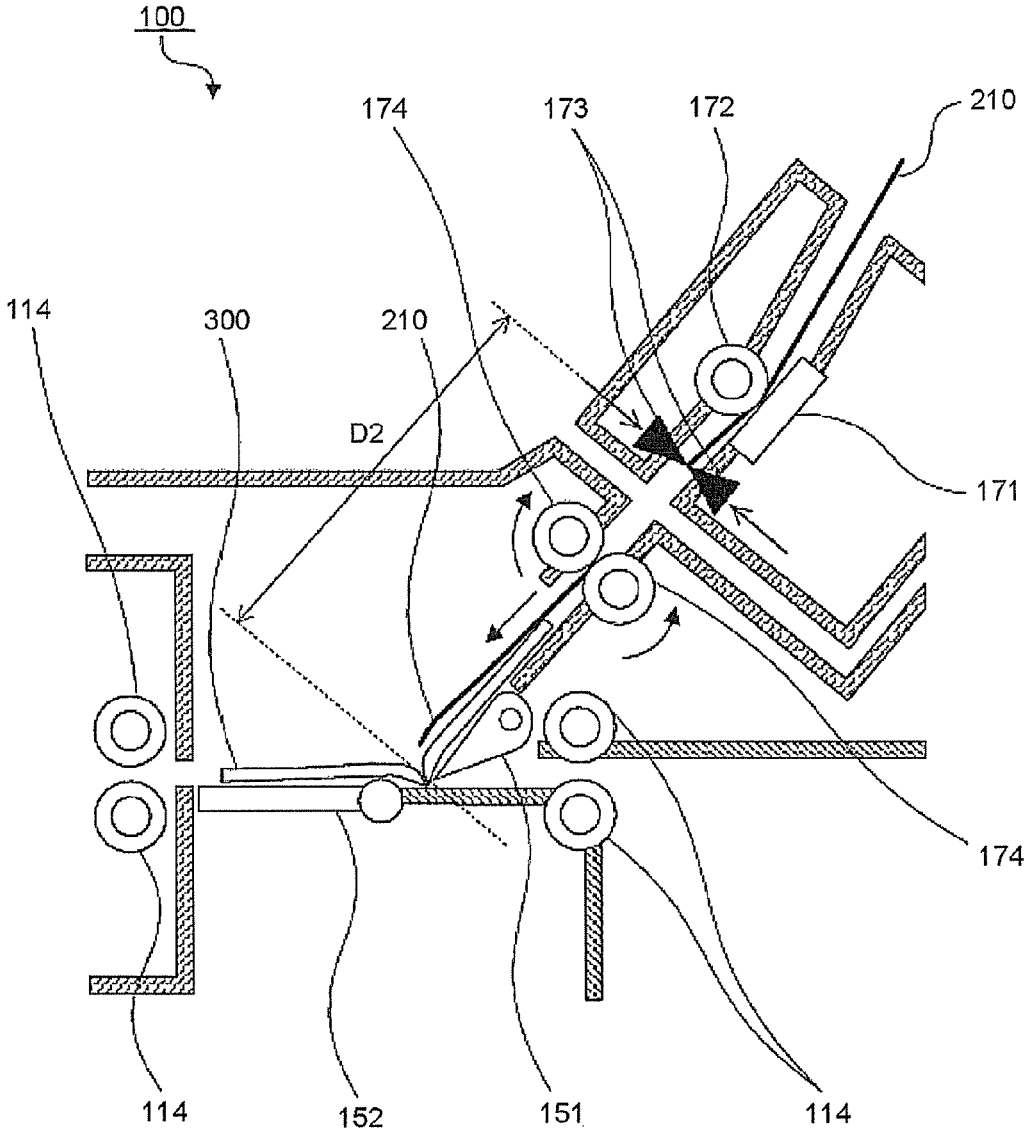
FIG. 9 is a diagram illustrating a state in which a sheet is output towards a bankbook.

Return to the flow shown in FIG. 7, the control section 180 carries out printing on the sheet 210 using the print head 171, meanwhile, the cutter 173 cuts and separates the printed part of the sheet 210. Moreover, the control section 180 outputs the cut and separated sheet 210 to the bankbook 300 (ACT S106). At this time, for example, as shown in FIG. 9, the control section 180 controls the rotation quantity of the output roller 174 so that the output quantity of the sheet 210 is smaller than the distance D2 from the cutter 173 to the merging position of the conveyance path 112, that is, the end side on the upstream side of the sheet 210 does not exceed the binding edge of the bankbook 300. Information of the rotation quantity of the output roller 174 (information of the output quantity of the sheet 210) is set by the producer or manager of the apparatus in advance and stored in the storage section 190. As stated above, the print head 171 is located below the platen roller 172. Thus, the sheet 210 is output in a state in which the lower side is a printing surface and the upper side is a non-printing surface. Consequentially, the sheet 210 is overlapped with the bankbook 300 with the printing surface thereof propped against the downstream one of the two facing pages of the bankbook 300.

Figure 10:
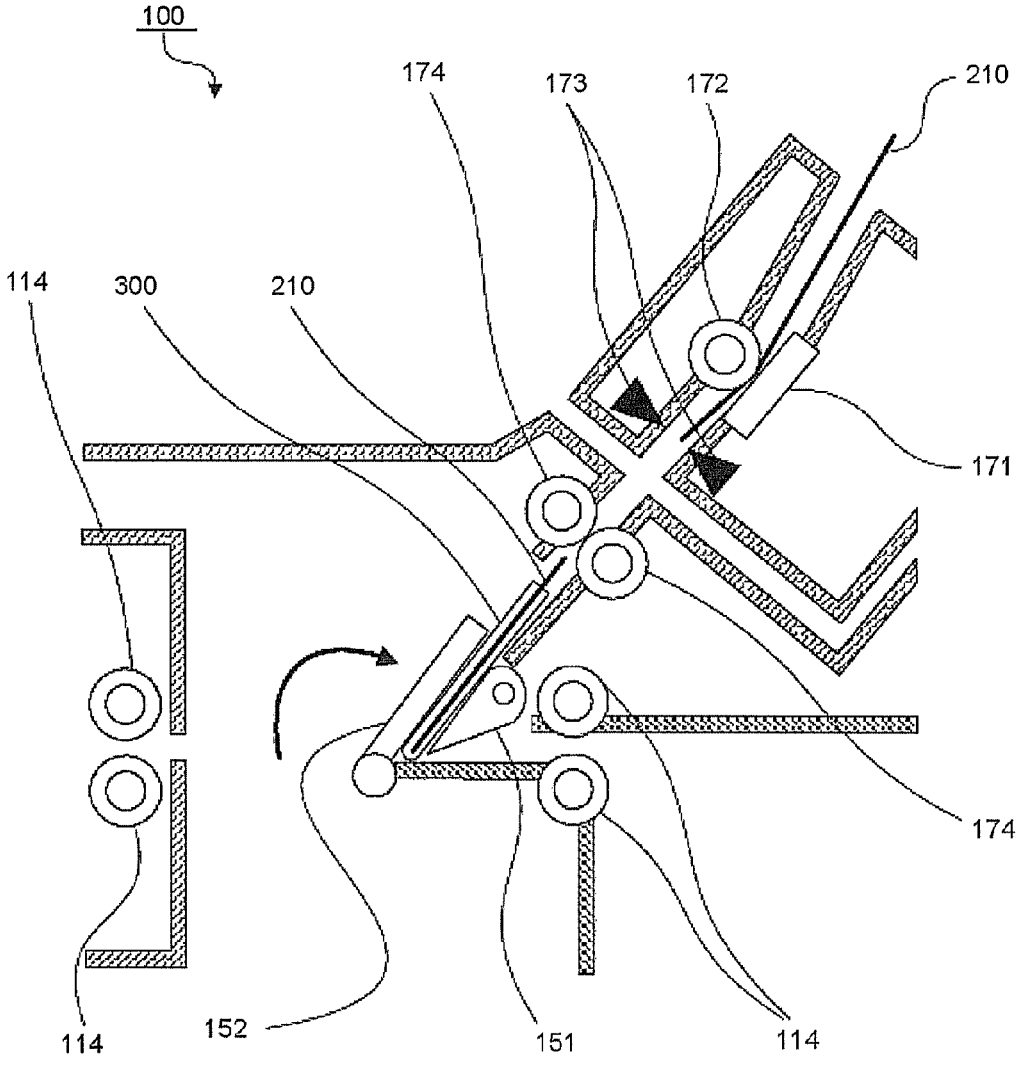
FIG. 10 is a diagram illustrating a state in which a bankbook is closed.

If the sheet 210 is overlapped with two facing pages of the bankbook 300, then the control section 180 rotates the rotary plate 152 clockwise to close the bankbook 300 (ACT S107), as shown in FIG. 10. As stated above, the rotary plate 152 has a rotation shaft on the downstream end thereof, and the rotation shaft is fixed nearby the merging position on the conveyance path 112. Thus, the rotary plate 152 is rotated to close the bankbook 300 with the half of the bankbook 300 at the upstream side overlapped with the half of the bankbook 300 at the downstream side. Consequentially, the back of the closed bankbook 300 faces the upstream. As stated above, the sheet 210 is overlapped with the downstream one of the two facing pages of the bankbook 300. As the bankbook 300 is closed, the sheet 210 is clamped between pages of the bankbook 300.

Figure 11:
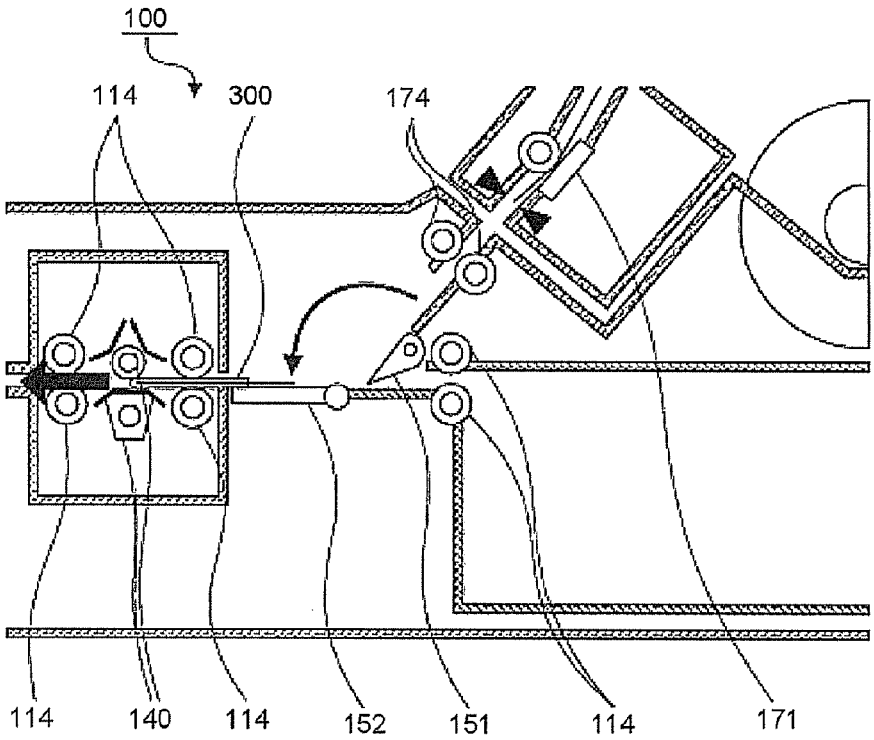
FIG. 11 is a diagram illustrating a state in which the rotary plate returned to an original position.
Figure 12:
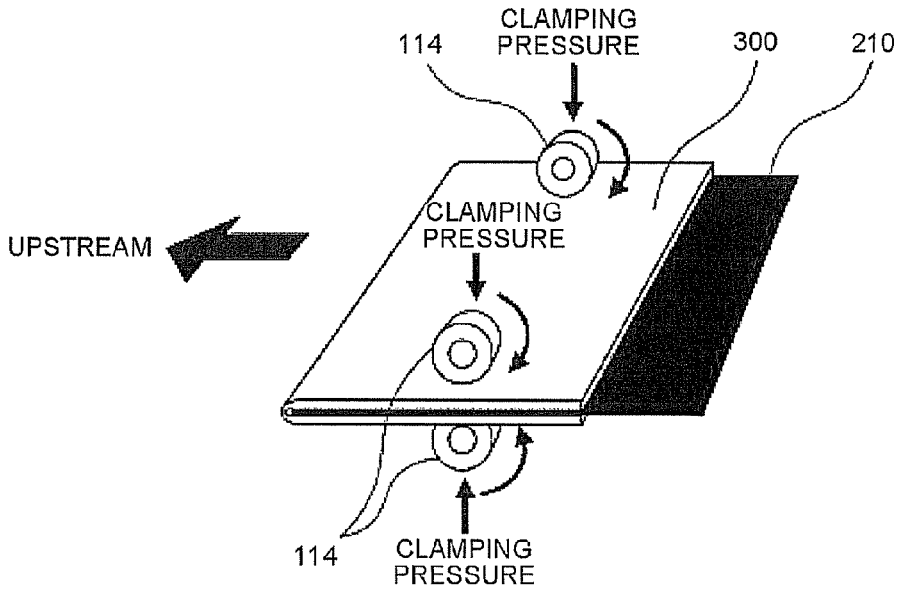
FIG. 12 is a diagram illustrating a state in which a bankbook is conveyed towards an upstream side with the back of the bankbook facing the upstream side.
Figure 13:
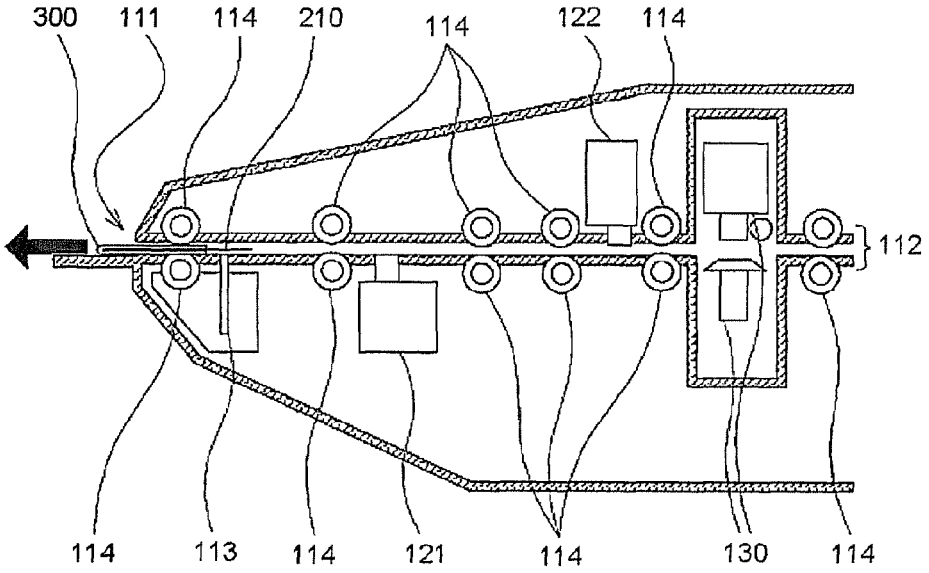
FIG. 13 is a diagram illustrating a state in which a bankbook is discharged from an insertion opening.

Next, for example, as shown in FIG. 11, the control section 180 rotates the rotary plate 152 anticlockwise to return the rotary plate 152 to the original position. Moreover, for example, as shown in FIG. 12, the control section 180 conveys the bankbook 300 towards the upstream with the back of the bankbook 300 facing the upstream (ACT S108). At this time, the control section 180 changes the clamping pressure applied to the bankbook 300 according to the pressure information 191. As stated above, the clamping pressure recorded in the pressure information 191 when the bankbook 300 is closed is smaller than that recorded in the pressure information 191 when the bankbook 300 is opened. Thus, the clamping pressure applied to conveying the bankbook 300 towards the upstream in ACT S108 is smaller than that applied in ACT S101 to conveying the bankbook 300 towards the downstream. Consequentially, No excessive clamping pressure is applied to the part of the sheet 210 protruded from the bankbook 300 when the bankbook 300 is conveyed towards the upstream in ACT S108. Thus, the sheet 210 is conveyed to the insertion opening 111 while being clamped by the bankbook 300, but not left on the conveyance path 112. If the bankbook 300 is nearby the insertion opening 111, for example, as shown in FIG. 13, the control section 180 opens the shutter 113 to discharge the bankbook 300 from the insertion opening 111.

Return to the flow shown in FIG. 7, the control section 180 determines whether or not the bankbook 300 is taken away from the insertion opening 111 according to the value of the pressure sensor (not shown) arranged on the furthest upstream conveyance roller 114 (ACT S109). If the bankbook 300 is taken away (Yes in ACT S109), the control section 180 closes the shutter 113 to end the bankbook printing processing. If the bankbook is not taken away (No in ACT S109), the control section 180 carries out ACT S110.

After the bankbook 300 reaches the insertion opening 111, the control section 180 determines whether or not the time preset by the producer or manager of the apparatus elapses (hereinafter referred to as 'set time') (ACT S110). If the set time does not elapse (No in ACT S110), the control section 180 returns and carries out ACT S109. If the set time elapses (Yes in ACT S110), the control section 180 carries out ACT S111.

Figure 14:
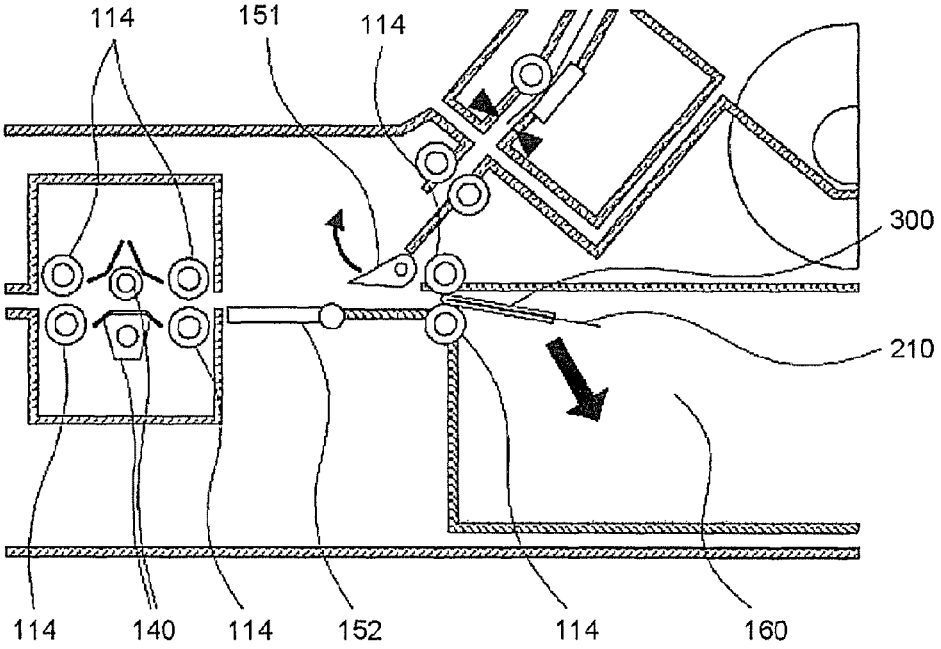
FIG. 14 is a diagram illustrating a state in which a bankbook is stored in a storage.

If the user forgets to take away the bankbook 300, for example, as shown in FIG. 14, the control section 180 collects the bankbook 300 in the collection storage 160 in a closed state (ACT S111). At this time, the clamping pressure applied to conveying the bankbook 300 from the insertion opening 111 to the collection storage 160 may be changed according to the clamping pressure recorded in the pressure information 191. After the bankbook 300 is collected in the collection storage 160, the control section 180 ends the bankbook printing processing.

According to the present embodiment, the bankbook 300 is discharged in a closed state, thus, the content printed on the bankbook 300 is protected from being seen by the people around, which frees the user from taking a look around when taking away the bankbook from the insertion opening.

Further, with the structure above, the bankbook printing apparatus 100 discharges the sheet 210 by clamping the sheet 210 in the bankbook 300, but not discharges the sheet 210 and the bankbook 300 separately, which avoids the situation that the user takes away the bankbook 300 but forgets to take away the sheet 210 and vice versa.

Further, with the structure above, the bankbook printing apparatus 100 conveys the closed bankbook 300 to the upstream with the back of the bankbook 300 facing the upstream side, thus reducing the possibility of the occurrence of JAM (paper jam inside the apparatus) caused by the curled front fore edge or the wrinkle of the front fore edge of the bankbook 300.

Moreover, with the structure above, the bankbook printing apparatus 100 conveys the bankbook 300 clamping the sheet 210 to the upstream with the back of the bankbook 300 facing the upstream, thus, the frequency of the occurrence of JAM is reduced even if the sheet 210 protrudes from the front fore edge of the bankbook 300.

Further, the bankbook printing apparatus 100 changes the clamping pressure applied by the conveyance roller 114 when conveying a closed bankbook 300 and when conveying an opened bankbook 300. More specifically, the clamping pressure applied to a closed bankbook 300 is smaller than that applied to an opened bankbook 300. As a result, no excessive clamping pressure is applied to the part of the sheet 210 protruded from the bankbook 300 during the conveyance process of the bankbook 300. Consequentially, the possibility is reduced that the sheet 210 is left inside the apparatus.

Further, the bankbook printing apparatus 100 controls the output quantity of the sheet 210 according to the preset information. More specifically, the bankbook printing apparatus 100 controls the rotation quantity of the output roller 174 to prevent the end side on the upstream side of the sheet 210 from exceeding the binding edge of the bankbook 300. Thus, one end of the sheet 210 is not curved when the bankbook 300 is closed.

Further, with the structure above, the bankbook printing apparatus 100 discharges the bankbook 300 from a discharging opening with the printing surface of the sheet 210 facing down. Thus, even if the sheet 210 protrudes from the bankbook 300, the possibility is reduced that the content printed on the protruded part of the sheet 210 is seen by the people around.

Further, the aforementioned embodiment is merely exemplary, and various modifications and applications can be devised.

For example, in the aforementioned embodiment, the sheet 210 is clamped in the printed pages of the bankbook 300 the pages of which are not turned over after the printing on the bankbook 300 but kept in the printed state, however, the sheet 210 may also be clamped between the last page of the bankbook 300 and the back side of the back cover of the bankbook 300. More specifically, in the bankbook printing apparatus 100, after the bankbook printing section 130 completes a printing operation, the page turning-over mechanism 140 turns over pages of the bankbook 300 until the last page appears, the sheet output mechanism 170 outputs the sheet 210 to the last page or the back side of the back cover of the bankbook 300, and then the sheet 210 is clamped between the last page and the back side of the back cover of the bankbook 300 by the closing mechanism 150. The clamped sheet 210 can be easily taken out from the bankbook 300.

Further, the bankbook printing apparatus 100 may clamp the sheet 210 between the leading page of the bankbook 300 and the back side of the front cover of the bankbook 300. More specifically, in the bankbook printing apparatus 100, after the bankbook printing section 130 completes a printing operation, the page turning-over mechanism 140 may turn over pages of the bankbook 300 until the leading page appears, the sheet output mechanism 170 outputs the sheet 210 to the leading page or the back side of the front cover of the bankbook 300, and then the sheet 210 is clamped between the leading page and the back side of the front cover by the closing mechanism 150. The sheet 210 clamped in the bankbook 300 can be taken out easily, like in the case where the sheet 210 is clamped between the last page and the back side of the back cover.

Further, the bankbook printing apparatus 100 may clamp the sheet between the print starting page and the page with which makes a pair of facing pages (e.g. the one of two facing pages which is at the downstream side if the print starting page is at the upstream side of the two facing pages and which is hereinafter referred to as 'opposite page'). More specifically, in the bankbook printing apparatus 100, after the bankbook printing section 130 completes a printing operation, the page turning-over mechanism 140 turns over pages of the bankbook 300 until the print starting page appears, the sheet output mechanism 170 outputs the sheet 210 to the print starting page or the opposite page, and then the sheet 210 is clamped between the print starting page and the opposite page by the closing mechanism 150. Thus, the user can easily know the print starting page.

Further, only one sheet 210 is clamped in the bankbook 300 in the aforementioned embodiment, however, a plurality of sheets may be clamped in the bankbook 300. More specifically, the bankbook printing apparatus 100 may output a plurality of sheets 210 to the bankbook 300 using the sheet output mechanism 170, and the closing mechanism 150 clamps the plurality of sheets in the bankbook 300. In this case, the bankbook printing apparatus 100 may clamp the plurality of sheets 210 in the same facing pages of the bankbook 300, or turns over pages using the page turning-over mechanism 140 while clamping the sheets 210 between different facing pages. If the printing pages include a plurality of facings pages, then sheets 210 may be separately clamped between the print starting page and the opposite page thereof and between the print ending page and the opposite page thereof. Thus, the user can easily know the print starting page and the print ending page.

Further, the bankbook 300, although closed by the rotary plate 152 in the aforementioned embodiment, can be closed in other ways. For example, like the rotary plate 152, a rodlike body provided with the closing mechanism 150 may be arranged in the bankbook printing apparatus 100 to close the bankbook 300. Further, a blower may be arranged in the bankbook printing apparatus 100 so that the closing mechanism 150 closes the bankbook 300 using the wind pressure of the blower.

Further, the page turning-over mechanism 140 may be set with a function of closing the bankbook 300 to function as the closing mechanism 150. More specifically, the page turning-over mechanism 140 may turn over pages of the bankbook 300 as well as the cover of the bankbook 300 to close the bankbook 300, according to the point of the turning-over of the pages of the bankbook 300.

Further, in the aforementioned embodiment, the bankbook 300 is closed with the back thereof facing the upstream, however, the closing mechanism 150 may close the bankbook 300 with the front fore edge of the bankbook 300 facing the upstream, that is, the back of the bankbook 300 facing the downstream side. At this time, the conveyance mechanism 110 may convey the bankbook 300 towards the upstream or the downstream with the back of the bankbook 300 facing the downstream.

Further, in the aforementioned embodiment, the upper and lower conveyance rollers 114 arranged in pairs are both rotationally driven, however, it is not necessary to rotationally drive both of the conveyance rollers 114. One of a pair of upper and lower conveyance rollers 114 may be arranged in a freely rotatable manner, the other one of the pair of upper and lower conveyance rollers 114 is rotationally driven to convey the bankbook 300 towards the upstream or downstream.

Further, in the aforementioned embodiment, the upper and lower conveyance rollers 114 arranged in pairs both apply a clamping pressure to the bankbook 300, however, it is not necessary for both of the two conveyance rollers 114 to apply a clamping pressure to the bankbook 300. Alternatively, it may be fixedly set that not both of the upper and lower conveyance rollers 114 arranged in pairs are moved up and down but only one conveyance roller 114 is moved up and down under the control of the control section 180 to apply a clamping pressure to the bankbook 300.

Further, in the aforementioned embodiment, the upper and lower conveyance rollers 114 arranged in pairs convey the bankbook 300 towards the upstream or downstream, however, it is not necessary that the conveyance rollers 114 are arranged to be an upper and lower rollers in pairs. For example, the lower surface of the conveyance path 112 may be set as a smooth surface so that the conveyance roller 114 presses the bankbook 300 on the smooth surface to convey the bankbook 300 towards the upstream or downstream.

Further, the bankbook printing section 130, although described as a dot printer in the aforementioned embodiment, is not limited to a dot printer. The bankbook printing section 130 may be a thermal printer or an inkjet printer. The bankbook printing section 130 may also be a laser printer.

Further, the print head 171, although described as a thermal head in the aforementioned embodiment, is not limited to a thermal head. The print head 171 may also be an inkjet print head used in an inkjet printer or a laser print head used in a laser printer.

Further, in the aforementioned embodiment, it is assumed that the sheet output mechanism 170 has a printing function; however, the sheet output mechanism 170 may have no printing function. In this case, information may be printed on the sheet 210 in advance.

Further, the sheet 210, although fed from the roll 200 in the aforementioned embodiment, is not necessarily fed from the roll 200. For example, a plurality of precut sheets 210 may be stored in the bankbook printing apparatus 100. Further, the sheet 210 may be normal paper or thermal paper.

Further, the sheet 210, although described as a statement in the aforementioned embodiment, is not limited to a statement. For example, the sheet 210 may also be an advertisement provided advertised content to the user or a receipt on which usage details are recorded.

Further, the control section 180 is housed in the bankbook printing apparatus 100 in the aforementioned embodiment; however, the control section 180 is not necessarily housed in the bankbook printing apparatus 100. For example, the processor of an ATM in which the bankbook printing apparatus 100 is mounted may function as the control section 180.

Further, it is described that the bankbook printing apparatus 100 is mounted in an ATM in the aforementioned embodiment; however, the bankbook printing apparatus 100 may be mounted in other apparatuses but is not necessarily mounted in an ATM. Further, the bankbook printing apparatus 100 may have the function of an ATM, or the bankbook printing apparatus 100 can be regarded as an ATM.

The bankbook printing apparatus 100 according to the present embodiment can be achieved by a dedicated system or a general computer system. For example, a program for executing the aforementioned operations may be stored in and a computer-readable recording medium and then distributed and then installed and executed in a computer, through executing the aforementioned processing, to function as the bankbook printing apparatus 100. Further, the program may also be stored in the disk of a server device on a network such as the Internet and then downloaded to a computer. Further, the functions may also be achieved through the cooperation of an OS (Operating System) with an application. In this case, the other sections excluding the OS may be stored in a medium and then distributed or stored in a server device and then downloaded to a computer.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A bankbook printing apparatus, comprising:

a bankbook printing section configured to print on a bankbook conveyed from an insertion opening in an opened state;

a closing mechanism configured to close the bankbook printed by the printing section;

a conveyance mechanism configured to convey the bankbook inserted into the insertion opening in an opened state towards a downstream and to convey the bankbook closed by the closing mechanism towards an upstream where the insertion opening is arranged and discharge the closed bankbook from the insertion opening; and a sheet output mechanism configured to output a sheet towards facing pages of the opened bankbook, wherein after the sheet output mechanism outputs the sheet, the closing mechanism clamps the sheet in the bankbook by closing the bankbook, and after the closing mechanism closes the bankbook, the conveyance mechanism conveys the bankbook towards the upstream and discharges the bankbook from the insertion opening with the sheet clamped in the bankbook.

2. The bankbook printing apparatus according to claim 1, wherein the closing mechanism closes the bankbook on which the sheet is placed with the back of the bankbook facing the upstream.

3. The bankbook printing apparatus according to claim 1, wherein the conveyance mechanism further comprises conveyance rollers configured to convey the bankbook towards the upstream and the downstream while applying a clamping pressure to the bankbook; and the conveyance rollers change the clamping pressure when conveying a closed bankbook and when conveying an opened bankbook.

4. The bankbook printing apparatus according to claim 2, wherein the conveyance mechanism conveys the bankbook closed by the closing mechanism towards the upstream with the back of the bankbook facing the upstream.

5. The bankbook printing apparatus according to claim 1, wherein the sheet output mechanism further comprises an output roller configured to output the sheet to the opened bankbook; and the rotation quantity of the output roller is controlled according to a preset output quantity.

6. The bankbook printing apparatus according to claim 1, wherein the conveyance mechanism comprises conveyance rollers configured to convey the bankbook towards the upstream and the downstream while applying a clamping pressure to the bankbook; and the conveyance rollers change the clamping pressure when conveying a closed bankbook and when conveying an opened bankbook.

7. The bankbook printing apparatus according to claim 1, comprising:

a page turning-over mechanism configured to turn over pages of the bankbook; wherein after the bankbook printing section completes the printing operation, the page turning-over mechanism turns over the pages until the print starting page of the bankbook appears;

the sheet output mechanism outputs the sheet to, after the print starting page of the pages turned over by the page turning-over mechanism appears, to the print starting page or the opposite page; and after the sheet is output, the closing mechanism clamps the output sheet between the print starting page and the opposite page.

8. The bankbook printing apparatus according to claim 1, wherein the sheet output mechanism further comprises a sheet printing section configured to print on one side of the sheet;

the closing mechanism clamps the sheet in the bankbook with the side printed by the sheet printing section facing down; and after the bankbook is closed, the conveyance mechanism discharges the bankbook from the insertion opening with the printed side facing down.

9. A bankbook printing method, comprising:

an insertion step of conveying a bankbook inserted from an insertion opening in an opened state towards a downstream;

a bankbook printing step of printing on the bankbook conveyed in the insertion step;

a closing step of closing the bankbook printed in the bankbook printing step;

a discharging step of conveying the bankbook closed in the closing step towards an upstream where the insertion opening is arranged and discharging the closed bankbook from the insertion opening; and an output step of outputting a sheet towards facing pages of the opened bankbook, including after the outputting the sheet, clamping the sheet in the bankbook by closing the bankbook, and after the closing the bankbook, conveying the bankbook towards the upstream and discharging the bankbook from the insertion opening with the sheet clamped in the bankbook.

* * * * *